US009815588B2

(12) United States Patent
Clark

(10) Patent No.: US 9,815,588 B2
(45) Date of Patent: Nov. 14, 2017

(54) STACKABLE STORAGE TRAY ADAPTABLE TO FORM AN ENCLOSED BOX

(71) Applicant: ClarkWerks LLC, Lehi, UT (US)

(72) Inventor: Douglas B. Clark, Lehi, UT (US)

(73) Assignee: CLARKWERKS LLC, Lehi, UT (US)

( * ) Notice: Subject to any disclaimer, the term of this patent is extended or adjusted under 35 U.S.C. 154(b) by 142 days.

(21) Appl. No.: 14/514,047

(22) Filed: Oct. 14, 2014

(65) Prior Publication Data

US 2016/0101895 A1 Apr. 14, 2016

(51) Int. Cl.

| | |
|---|---|
| ***B65D 6/00*** | (2006.01) |
| ***B65D 6/24*** | (2006.01) |
| ***A47B 87/02*** | (2006.01) |
| *B65D 21/02* | (2006.01) |
| *B65D 5/68* | (2006.01) |
| *B65D 5/00* | (2006.01) |
| *B65D 81/133* | (2006.01) |

(52) U.S. Cl.

CPC ..... *B65D 11/188* (2013.01); *A47B 87/0269* (2013.01); *B65D 5/001* (2013.01); *B65D 5/0035* (2013.01); *B65D 5/685* (2013.01); *B65D 11/10* (2013.01); *B65D 21/0212* (2013.01); *B65D 21/0234* (2013.01); *B65D 81/133* (2013.01)

(58) Field of Classification Search

CPC .. B65D 11/188; B65D 11/10; B65D 21/0212; B65D 21/0234; B65D 5/685; B65D 5/001; B65D 5/035; B65D 81/133; A47B 87/0269

USPC ..... 220/4.21; 206/503, 509, 523, 701; 229/164, 125.29, 125.32, 901, 915

See application file for complete search history.

(56) References Cited

U.S. PATENT DOCUMENTS

| | | | | | |
|---|---|---|---|---|---|
| 1,357,519 | A | * | 11/1920 | Russell | B65D 5/68 229/125.32 |
| 2,487,168 | A | * | 11/1949 | Mordkin | B65D 21/0234 206/509 |
| 4,244,509 | A | | 1/1981 | Dlugopolski | |
| 4,362,265 | A | | 12/1982 | Williams | |
| 4,469,231 | A | | 9/1984 | Hehn | |
| 4,657,148 | A | | 4/1987 | Heng | |
| 4,785,939 | A | | 11/1988 | Huerto et al. | |
| 4,823,955 | A | | 4/1989 | Apps | |

(Continued)

FOREIGN PATENT DOCUMENTS

| | | | | |
|---|---|---|---|---|
| DE | 1486241 | * | 5/1969 | B65D 6/00 |
| WO | 9525018 A1 | | 9/1995 | |

*Primary Examiner* — Fenn C Mathew
*Assistant Examiner* — Elizabeth Volz
(74) *Attorney, Agent, or Firm* — Durham Jones & Pinegar, P.C.; Christopher L. Wight

(57) ABSTRACT

A stackable storage tray that can be combined with an identical stackable storage tray to form an enclosed box. The stackable storage tray comprises a flat base, a rear wall, two side walls, and an open front. Each of the two side walls are complementary with the respective side walls of a second identical stackable storage tray, so that when one storage tray is flipped upside down the two trays form an enclosed box—the open front of the stationary tray receives the complementary rear wall of the flipped tray, the rear wall of the stationary tray fits in the complementary open front of the flipped tray, and the sides have side walls and open spaces that are complementary reverse mirror images of each other and fit together to form an enclosed box.

24 Claims, 11 Drawing Sheets

(56) References Cited

U.S. PATENT DOCUMENTS

| | | | | |
|---|---|---|---|---|
| 4,863,042 | A | 9/1989 | Rohner | |
| 4,974,733 | A | 12/1990 | Evans | |
| 5,299,690 | A | 4/1994 | Mund et al. | |
| 5,363,974 | A | 11/1994 | Chan | |
| 5,590,788 | A | 1/1997 | Inman | |
| 6,935,503 | B2 | 8/2005 | Phan | |
| 2006/0175388 | A1 | 8/2006 | Arnold et al. | |
| 2008/0073340 | A1* | 3/2008 | Lin | B65D 5/324 220/6 |
| 2008/0169216 | A1 | 7/2008 | Kaltz | |
| 2012/0241350 | A1 | 9/2012 | Stahl | |

* cited by examiner

STACKABLE STORAGE TRAY ADAPTABLE TO FORM AN ENCLOSED BOX

FIELD OF THE INVENTION

The present invention generally relates to stackable trays used for organizing, sorting, displaying and accessing various items. More particularly, the invention relates to stackable trays that are complementary, can be stacked together, and inverted and interleaved together to form a box-like container.

BACKGROUND

There are numerous embodiments of trays for organizing, sorting, displaying, and accessing various items. Many of these trays stack, one upon another, allowing for efficient use of space, among other things. One good example is the office tray, used for sorting mail (incoming and outgoing), office documents, etc. Many other applications can be found where stackable trays are used to facilitate organization or display.

One limitation of current trays is that they do not facilitate transportation or storage of their contents, requiring another suitable container to be acquired for this purpose. The present invention embodies a stackable tray that allows for the organization, sorting, displaying, and accessing of the usual items while also providing a means for the protection, transportation, and storage of the items in question.

SUMMARY OF THE INVENTION

Accordingly, one embodiment of the invention provides a tray for holding the organizable, sortable, displayable items, comprising a flat base, a rear wall of a preselected thickness affixed to the base and extending a preselected height from the base, a front lip extending parallel to the base approximately the same length as the width of the rear wall, and a pair of side walls extending to substantially the same height from the base as the rear wall, each extending along approximately half of the perimeter of each side of the base.

To allow for the formation of a stack of trays, the bottom of the base below the rear wall, the bottom of the base below each of the two side walls, the top of the rear wall, and the tops of each of the two side walls may include a complementary engagement element adapted to prevent relative horizontal and vertical movement of two trays affixed one on top of the other, forming a stack. Trays can continue to be stacked one on top of the other to any arbitrary height utilizing a suitable number of trays.

The tray may be adapted to allow for the formation of a stackable container by inversion of one tray over another tray. The front lip and the sides of the base not covered by the side walls may include a complementary engagement element adapted to prevent relative horizontal and vertical movement of two trays forming a stackable container. These engagement elements are complementary to and engage with corresponding engagement elements on the top of the rear wall and the tops of the side wall.

In order to facilitate stacking of trays formed into a container, the bottom of the tray may include complementary engagement elements which prevent fore and aft movement of containers stacked one on top of the other.

Another embodiment of the invention provides a tray, comprising a base wall, a rear wall of a preselected height, and multiple side walls of the same preselected height as the rear wall, with each side arranged in a configuration such that it is still possible to form a stackable container by inversion of one tray over another tray.

Still another embodiment of the invention provides a tray, comprising a base wall, a rear wall of a preselected height, and multiple side walls of differing heights, each side arranged in a configuration such that it is still possible to form a stackable container by inversion of one tray over another tray.

In one aspect, the present invention provides a stackable storage tray and box system, comprising a base comprising a rear wall connected to a rear edge of the base and one or more side wall connected to each side of the base, wherein the base has an open front and one or more space between each side wall and between a side wall and the rear wall, wherein the sidewalls and the spaces between the side walls is configured such that the one or more side wall and one or more space between the from edge of the base and a center line between the front and the rear of the base is a reverse mirror image of the one or more side wall and one or more space between the centerline of the base and the rear edge of the base.

In one particular embodiment, the present invention provides a stackable storage tray, comprising a base comprising a rear edge, a first side edge, a second side edge and a front edge. The base has walls, including a rear wall having a bottom edge connected to the rear edge of the base, a first side wall and a second side wall, wherein the first side wall is connected to the first side edge of the base and is spaced apart from the rear wall by a distance substantially equal to the width of the first side wall to form a first side space, and the second side wall is connected to the second side edge of the base and is spaced apart from the rear wall by a distance substantially equal to the width of the second side wall to form a second side space, and wherein the front edge has no side wall, thereby forming an open front space. In some embodiments, the heights of the rear wall, the first side wall and the second side wall are substantially equal. The stackable storage tray is configured to be inverted and interleaved with a second identical stackable storage tray, such that the rear wall of the storage tray interleaves with the open front space of the second storage tray, the first side wall of the storage tray interleaves with the first side space of the second storage tray, and the second side wall of the storage tray interleaves with the second side space of the second storage tray, thereby forming an enclosed box.

In some embodiments, the walls and/or the base of the stackable tray include engagement elements that are complementary and are configured to interact in a complementary manner so as to secure two or more trays together in either a stacking arrangement or with one tray inverted and interleaved with a second tray. In a particular embodiment, at least two or more of the back side wall, first side wall and second side wall of the stackable tray may further comprise an engagement element on a top portion, wherein the stackable storage tray is configured to be stackable on top of the second identical stackable storage tray and the complementary engagement elements engage with corresponding complementary engagement elements on a bottom portion of the base, thereby preventing relative horizontal movement of the first stackable storage tray and second identical stackable storage tray. In yet another embodiment, the stackable tray may comprise complementary engagement elements on the top of the base in the first side space and second side space that are complementary to the engagement elements on the top of the first side wall and second side wall. The engagement elements may, for example, comprise a curved concave and complementary curved convex shaped surface. In another embodiment, the engagement elements comprise a plurality of studs and complementary holes. In some embodiments, the first side space and second space are substantially equal in width.

In another aspect, the present invention may include a plurality of side walls on each side of the tray. In some embodiments, for example, the stackable tray may further comprise, in addition to the first side wall and second side wall, a third side wall and third space on the first side edge of the base, wherein the third side wall is positioned between the first side wall and the rear wall, and the third side wall has a width that is substantially equal to and is positioned to insert within the third space when the storage tray is inverted and interleaved with a second identical storage tray, and also a fourth side wall and fourth space on the second side edge of the base, wherein the fourth side wall is positioned between the second side wall and the rear wall, and the fourth side wall has a width that is substantially equal to and is positioned to insert within the fourth space when the storage tray is inverted and interleaved with a second identical storage tray.

In those embodiments having a plurality of side walls on each side of the base, it is possible that one or more of the side walls on one side of the base have a different height than other side walls. For example, in one embodiment those side walls in the middle (i.e., between the rear wall and the side walls nearest the front edge of the base) are lower in height. In a particular embodiment, for example, the height of the third side wall is less than the height of the first side wall and the third space comprises a partial side wall having a height substantially equal to the difference in height between the first side wall and the third side wall, and wherein the height of the fourth side wall is less than the height of the second side wall and the fourth space comprises a partial side wall having a height substantially equal to the difference in height between the second side wall and the fourth side wall.

In another embodiment, the first side wall comprises a first portion that is substantially equal in height to the rear wall and a second portion that is lower in height than the rear wall, and wherein the second side wall comprises a first portion that is substantially equal in height to the rear wall and a second portion that is lower in height than the rear wall.

In yet another aspect, the present invention provides a stackable storage tray having one or more side walls that are connected to the rear wall. For example, in one particular embodiment, the present invention provides a stackable storage tray, comprising a base comprising a rear edge, a first side edge, a second side edge and a front edge. In this embodiment the tray has a rear wall having a bottom edge connected to the rear edge of the base, a first side edge and a second side edge, a first rear side wall and second rear side wall, wherein the first rear side wall has a bottom edge connected to the first side edge of the base and a rear edge connected to a first side edge of the rear wall, and the second rear side wall has a bottom edge connected to the second side edge of the base and a rear edge connected to the second side edge of the rear wall; a first side wall and a second side wall, wherein the first side wall is connected to the first side edge of the base and is spaced apart from the first rear side wall by a distance substantially equal to the width of the first side wall to form a first side space and is spaced apart from the front edge by a distance substantially equal to the width of the first rear side wall to form a first side front space, and the second side wall is connected to the second side edge of the base and is spaced apart from the second rear side wall by a distance substantially equal to the width of the second side wall to form a second side space and is spaced apart from the front edge by a distance substantially equal to the width of the second rear side wall to form a second side front space, and wherein the front edge has no side wall, thereby forming an open front space. The height of the rear wall, the first side wall and the second side wall is substantially equal. This stackable storage tray is configured to be inverted and interleaved with a second identical stackable storage tray, such that the rear wall and connected first rear side wall and second rear side wall of the storage tray interleaves with the open front space of the second storage tray and the first and second side front space, the first side wall of the storage tray interleaves with the first side space of the second storage tray, and the second side wall of the storage tray interleaves with the second side space of the second storage tray, thereby forming an enclosed box.

In yet another aspect, the present invention provides a stackable storage tray comprising a plurality of first and second side walls spaced apart and configured to interleave with one another.

In yet another aspect, the present invention provides a stackable storage tray and box system, comprising a first stackable storage tray as described above and a second identical stackable storage tray. Such a system of stackable storage trays may be used by stacking the first storage tray on top of the second storage tray. Alternatively, the first stackable tray may be inverted and placed upon the second stackable tray in such a manner that the side walls of the first tray slide within the side spaces of the second tray, thereby allowing the first tray and the second tray to interleave and forming an enclosed container.

These and other aspects of the present invention are realized in the present specification and claims, as shown and described in the following figures and related description. It will be appreciated that various embodiments of the invention may not include each aspect set forth above and aspects discussed above shall not be read into the claims unless specifically described therein.

BRIEF DESCRIPTION OF THE DRAWINGS

The present invention is illustrated and described in reference to the accompanying drawings in which.

Figure 1:
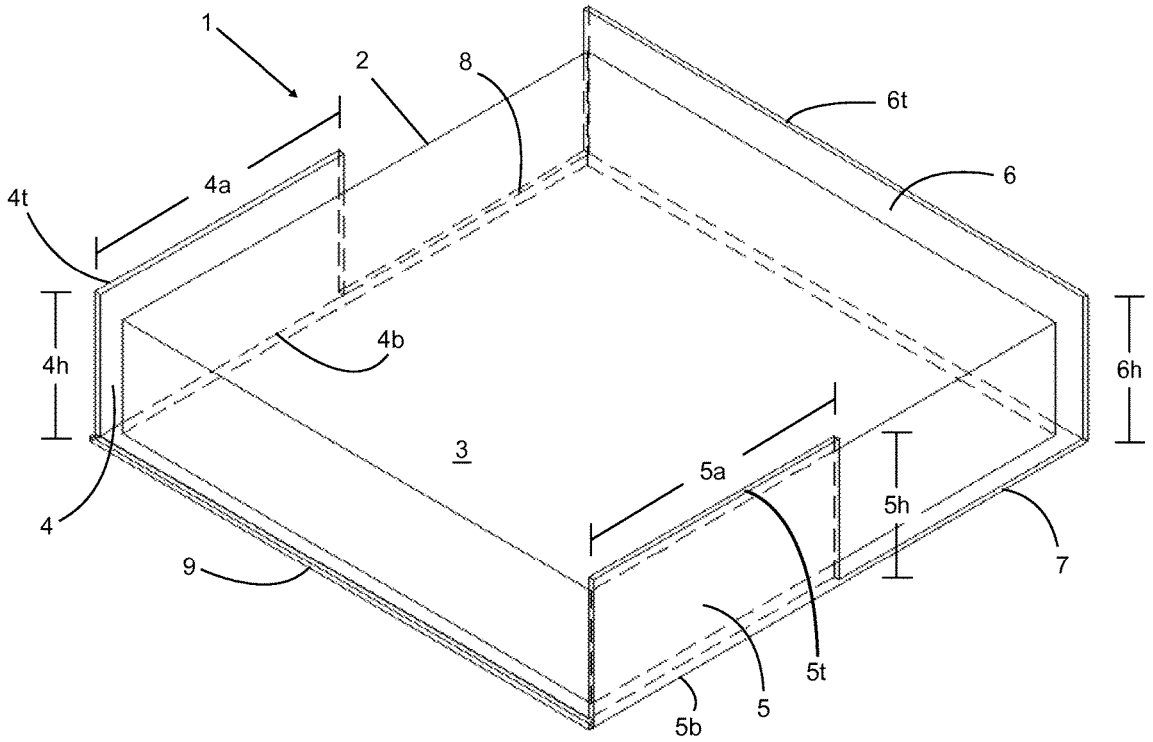
FIG. 1 is a perspective view of a tray constructed in accordance with one embodiment of the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The skilled artisan will understand, however, that the apparatuses, systems and methods described below can be practiced without employing these specific details, or that they can be used for purposes other than those described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment" or "an embodiment" means that a particular feature, structure, or characteristic described in connection with the embodiment is included in at least one embodiment, but is not a requirement that such feature, structure or characteristic be present in any particular embodiment unless expressly set forth in the claims as being present. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the invention may be combined in any suitable manner in one or more embodiments. In the following description, numerous specific details are provided, such as examples of products or manufacturing techniques that may be used, to provide a thorough understanding of embodiments of the invention. One skilled in the relevant art will recognize, however, that embodiments of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present disclosure is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, it is understood that a reference to "an engagement element" may include one or more of such engagement elements. In particular, with respect to the construction of claims, it is further understood that a reference to "an engagement element" reads on an infringing device that has more than one engagement element, since such infringing device has "an engagement element", plus additional engagement elements. Accordingly, the use of the singular article "a," "an," and "the" is considered open-ended to include more than a single element, unless expressly limited to a single element by such language as "only," or "single."

As used herein, the term "substantially" refers to the complete or nearly complete extent or degree of an action, characteristic, property, state, structure, item, result or function as indicated. For example, an object that is "substantially" enclosed would mean that the object is either completely enclosed or nearly completely enclosed, such that it retains the function of a completely enclosed object. The exact allowable degree of deviation from absolute completeness may in some cases depend on the specific context, for example, such that enclosing an element would be substantially enclosed, even if the distal end of the structure enclosing the element had a slit or channel formed along a portion thereof. The use of "substantially" is equally applicable when used in a negative connotation to refer to the complete or near complete lack of an action, characteristic, property, state, structure, item, or result. For example, a structure which is "substantially free of" a bottom would either completely lack a bottom or so nearly completely lack a bottom that the effect would be functionally the same as if it lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

In one aspect, the present invention provides a stackable storage tray comprising a base, a first and second side wall, and a rear wall, configured to be stacked with a second identical storage tray and also, in another configuration, to be inverted and interleaved with an identical second tray. Generally, the base has a rear edge, a first side edge, a second side edge and a front edge. The rear wall has a bottom edge that is connected to the rear edge of the base. In one particular embodiment, the first side wall is connected to the first side edge of the base and is spaced apart from the rear wall by a distance substantially equal to the width of the first side wall to form a first side space, and the second side wall is connected to the second side edge of the base and is spaced apart from the rear wall by a distance substantially equal to the width of the second side wall to form a second side space, while the front edge has no side wall, thereby forming an open front space. In some embodiments of the present invention, the heights of the rear wall, the first side wall and the second side wall are substantially equal. In the above configuration, the stackable storage tray is configured to be inverted and interleaved with a second identical stackable storage tray, such that the rear wall of the storage tray interleaves with the open front space of the second storage tray, the first side wall of the storage tray interleaves with the first side space of the second storage tray, and the second side wall of the storage tray interleaves with the second side space of the second storage tray, thereby forming an enclosed box.

As used herein, the term "connected," when used in reference to the base of the storage tray being "connected" to a side wall or rear wall, means that two elements are joined together such that they operate as a single unit, for example, by being welded or fused together, or by being secured together by screws or nuts and bolts, or any other type of joint or connecting device known to those in the art for securing two elements together. Alternatively, two elements may be joined together by being manufactured as a single integrated piece, such as by being molded in a single mold.

In addition, the term "edge," as used herein, is understood to mean the outer perimeter or region of an element, and may include the outermost border of an element, or a region near the outermost border. For example, in reference to the edge of the base, the rear wall and/or side wall may be positioned on the edge of the base by placing it on the base such that the outer portion of the side wall is flush with the outermost side of the base. Alternatively, the rear wall and/or side wall may be positioned near the edge of the base by placing it on the base such that the side of the base extends out from the side of the side wall or rear wall.

As used herein, the term "substantially equal," when used in reference to the relative dimensions of two elements (such as a side wall and a corresponding space into which the side wall interleaves, or the relative height of the side walls and rear wall), means that the dimensions are sufficiently similar that the proper functioning of the stackable storage trays (i.e., interleaving, and stacking) is not materially compromised. The two elements may interleave together in a relatively tight fit, or alternatively may interleave together in a loose fit. In some embodiments, the elements may interleave together in a fit that is sufficiently loose that there remains a space between the interleaved elements, for example, where storage of items requires ventilation or an air tight fit is not necessary or desirable. In any event, it is understood that some tolerance for an imprecise fit is acceptable for the proper interleaving and stacking of the stackable storage trays and that precise equivalency of dimensions is not necessary.

As used herein, the term "enclosed," when used in reference to a stackable storage tray being inverted and interleaved with a second stackable storage tray to create an "enclosed" box, means that the interleaved trays fit together sufficiently tight that they are able to effectively retain the contents of the box. In some embodiments, for example where large pieces of paper are being stored, it will not be necessary for the tolerances between the two boxes to be precise, as some space between the two trays can be tolerated while retaining the large pieces of paper within the box. In other embodiments, where small items, such as game pieces are being stored, it may be desirable to have closer fitting tolerances to keep such pieces within the box during storage. In yet other embodiments, a very tight fit may be desirable so as to achieve a substantially air-tight fit. In any event, the term "enclosed" should not be construed to require an absolutely air-tight fit in all embodiments.

The term "inverted," as used herein, means that a tray is flipped over upside down, moving the front portion to the back and the back portion to the front.

In another aspect, the stackable storage trays of the present invention may further comprise engagement elements on the top of the side walls and the rear wall, and on the top of the base within the spaces between the side walls, as well as on the bottom of the base, to keep stacked or interleaved trays from sliding relative to one another. In one embodiment, the stackable storage tray comprises an engagement element having at least two or more of the back side wall, first side wall and second side wall further comprise an engagement element on a top portion. The stackable storage tray is configured to be stackable on top of the second identical stackable storage tray and the complementary engagement elements engage with corresponding complementary engagement elements on a bottom portion of the base, thereby preventing relative horizontal movement of the first stackable storage tray and second identical stackable storage tray.

In yet another aspect, the stackable storage tray comprises complementary engagement elements on the top of the base in the first side space and second side space that are complementary to the engagement elements on the top of the first side wall and second side wall.

As described and defined herein, and as further illustrated in the drawings, the engagement elements may comprise any type of reversible joint configuration that temporarily joins two stackable storage trays together and effectively prevents the stackable storage trays from sliding relative to each other when they are stacked or interleaved. Such engagement elements may include, for example, such configurations as studs/holes, concave/convex surfaces, ridges/valleys, steps/ledges, mortise/tenons, tongue and groove type joints, clasps, hooks, or other configurations. By way of example, in one embodiment of the invention, a complementary engagement element is provided that comprises studs and holes, i.e., a stud on one tray that is complementary to a hole on the second tray. Such a configuration, with a plurality of studs and complementary holes, is illustrated in FIGS. 5, 6, 7 and 8. In another embodiment, a complementary engagement element is provided that comprises a curved concave surface on one tray and a complementary curved convex shaped surface on another tray. Other suitable engagement elements may also be used. It will be understood that the engagement elements need not be precisely "complementary", so long as the arrangement and sizing is sufficient to prevent two stackable trays from sliding relative to one another. It will be further understood that the particular engagement elements selected may be all of the same type of configuration (i.e., all studs and holes), or may be a mixture of different types of engagement elements (i.e., studs and holes in some locations, with tongue and groove at other locations).

In some embodiments, the engagement element may also include a snap feature that will allow the engagement element to reversibly lock into place with a slight pressure. For example, the engagement element, such as a stud and a hole, may include a protruding ridge around the side of the stud and a complementary recess within the hole (or vice versa), or alternatively a sphere shaped element at the top of the stud that is complementary to a sphere shaped recess at the bottom of the hole, which snaps into place when the stud is inserted within the hole. Other types of reversible locking features or snapping configurations known to those skilled in the art are also contemplated.

Figure 2:
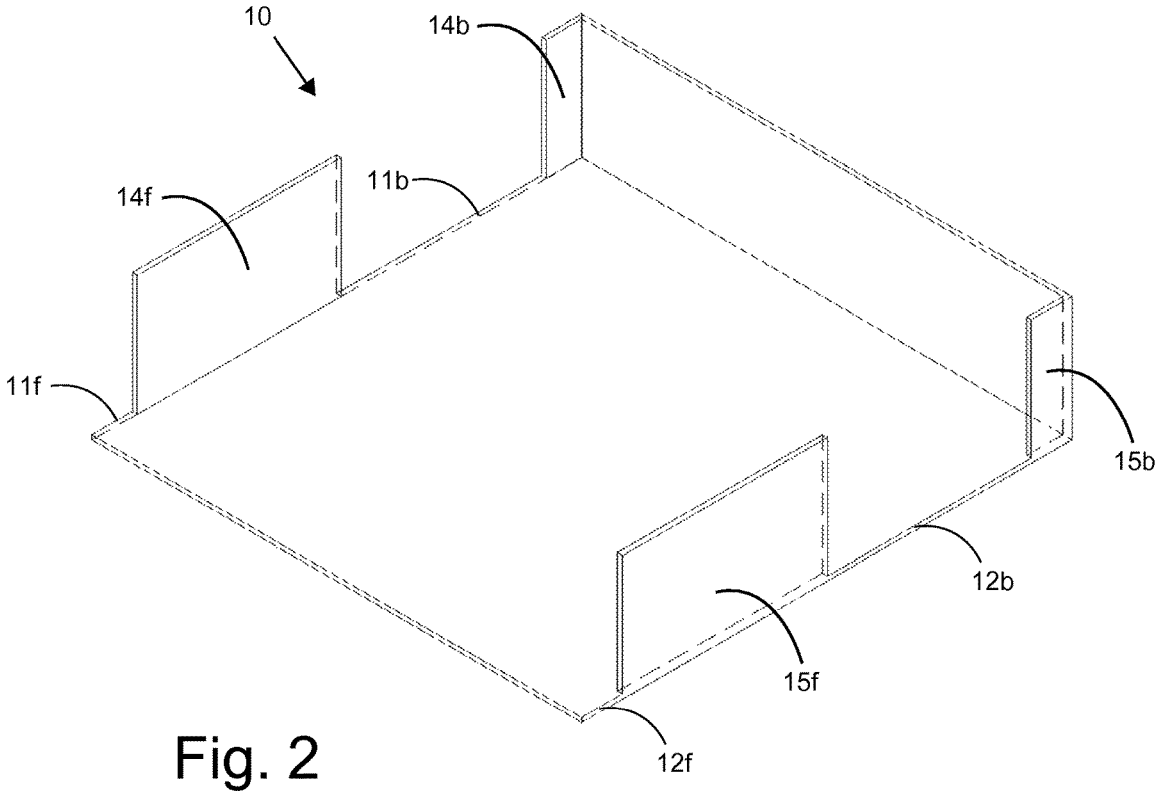
FIG. 2 is a perspective view of another form of the present invention.
Figure 5:
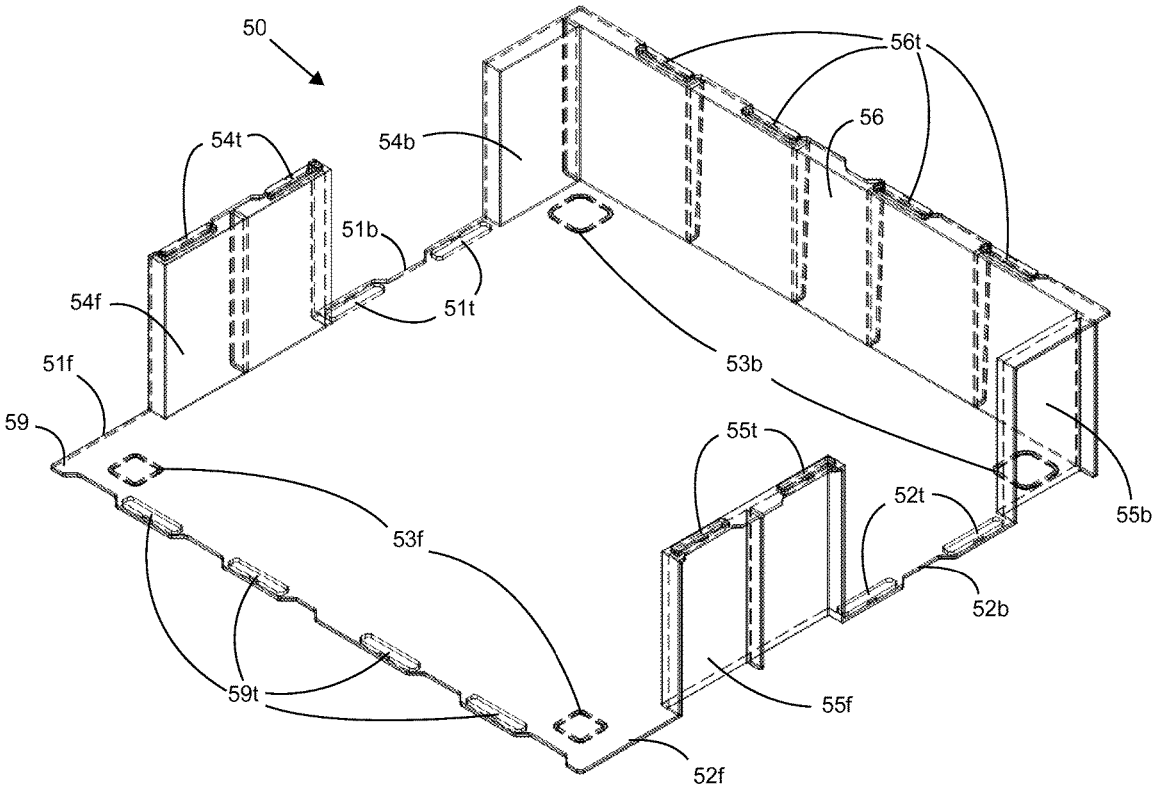
FIG. 5 is a perspective view of another form of the present invention.
Figure 9:
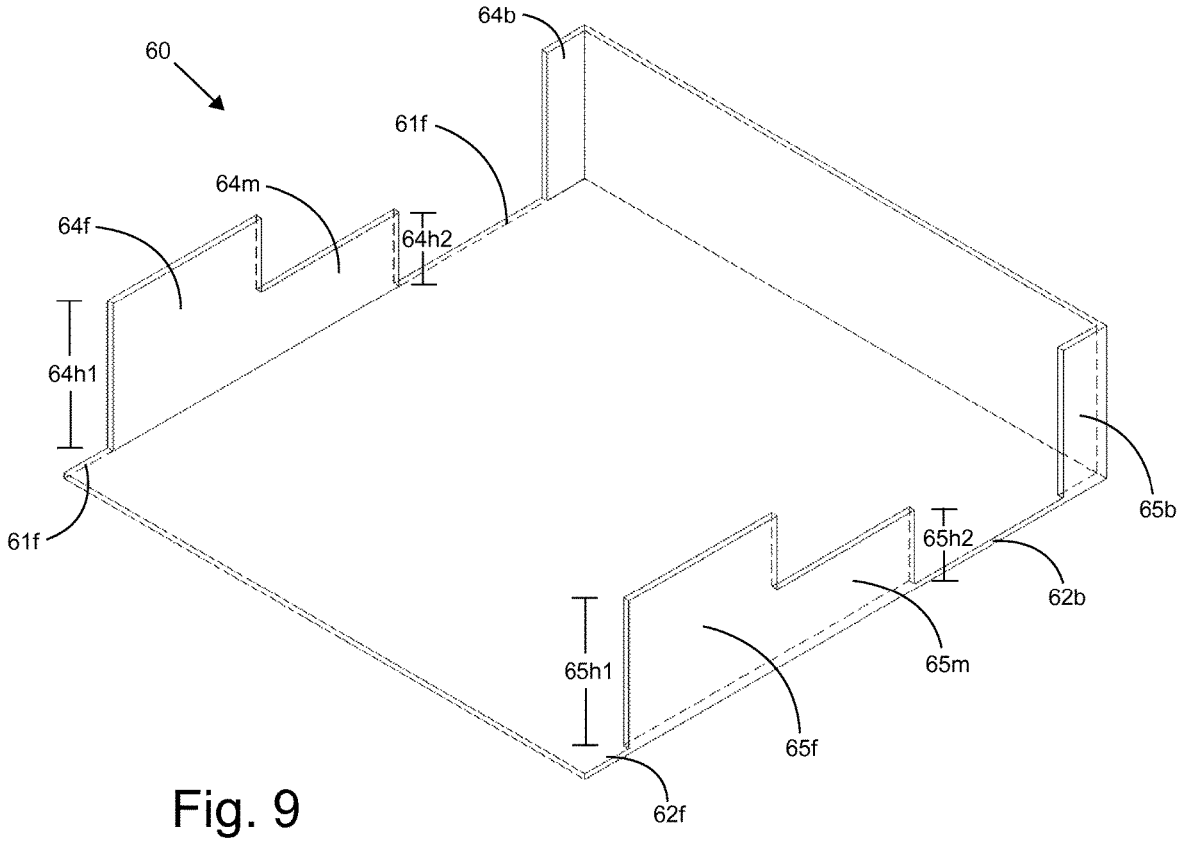
FIG. 9 is a perspective view of another form of the present invention.

In accordance with one aspect of the present invention, the configuration of the sidewalls and the spaces between the side walls is a "reverse" minor image about the centerline between the rear edge of the base and the front edge of the base. For example, as illustrated in FIG. 1, the "reverse" mirror image of the sidewall 5 is the open side space 7 (i.e., the "reverse" of the wall is a space), with the length of the sidewall 5 substantially equal to the length of the open side space 7. Similarly, as illustrated in FIG. 2, the "reverse" mirror image of the side wall 15*f* is the open side space 12*b*, with the length of the sidewall 15*f* substantially equal to the length of the open side space 12*b*; and the "reverse" minor image of the open side space 12*f* is the rear side wall 15*b* that is connected to the rear wall, with the length of the side space 12*f* substantially equal to the length of the rear side wall 15*b*. Other similar "reverse" mirror image configurations are also possible, as illustrated in such embodiments as shown in FIGS. 5 and 9. Such similar "reverse" minor image configurations could, for example, further include a plurality of side walls that minor a plurality of corresponding open side spaces. Such a "reverse" minor image configuration enables a first tray to be inverted and interleaved with a second identical tray, to form an enclosed container.

Accordingly, in one aspect the present invention provides a stackable storage tray, comprising a base comprising an open front, a rear wall, and on each side of the base at least one side wall and at least one space, wherein each side of the base from the front of the base to a center line between the front and the rear of the base comprises at least one side wall, and each side of the base from the centerline to the rear of the base comprises at least one space; and wherein the configuration from the front of the base to the centerline is a reverse mirror image of the configuration from the centerline to the rear of the base, such that the stackable storage tray can be inverted and interleaved with a second identical stackable storage tray. In some embodiments, the configuration of the at least one side wall and at least one space on each side of the base is the same. In other embodiments, each side of the base from the front of the base to the center line comprises at least one side wall and at least one space, and each side of the base from the centerline to the rear of the base comprises at least one space and at least one side wall.

In another aspect, the present invention provides a stackable storage tray having a plurality of side walls. In one particular embodiment, the stackable storage tray comprises (i) a third side wall and third space on the first side edge of the base, wherein the third side wall is positioned between the first side wall and the rear wall, and the third side wall has a width that is substantially equal to and is positioned to insert within the third space when the storage tray is inverted and interleaved with a second identical storage tray; and (ii) a fourth side wall and fourth space on the second side edge of the base, wherein the fourth side wall is positioned between the first side wall and the rear wall, and the third side wall has a width that is substantially equal to and is positioned to insert within the fourth space when the storage tray is inverted and interleaved with a second identical storage tray.

In another aspect, the present invention provides side walls having a different height. In one embodiment, the height of the third side wall is less than the height of the first side wall and the third space comprises a partial side wall having a height substantially equal to the difference in height between the first side wall and the third side wall. In this embodiment, the height of the fourth side wall is less than the height of the second side wall and the fourth space comprises a partial side wall having a height substantially equal to the difference in height between the second side wall and the fourth side wall. It is understood that in the above embodiment, it will be desirable that side walls in the front portion of the tray will have a height that is substantially equal to the height of the rear wall, so that when the trays are stacked the upper trays are level with (i.e., parallel to) the bottom tray.

In another embodiment, the present invention provides a stackable storage tray comprising a plurality of side walls, where one of the sidewalls is connected to the rear wall, as illustrated in FIG. 2. Specifically, the base has a rear edge, a first side edge, a second side edge and a front edge, and the rear wall has a bottom edge connected to the rear edge of the base. Two separate side walls are provided: primary side walls, and rear side walls. The rear side walls comprise a first rear side wall on one side of the tray and second rear side wall on the other side of the tray. The first rear side wall has a bottom edge connected to the first side edge of the base and a rear edge connected to a first side edge of the rear wall, while the second rear side wall has a bottom edge connected to the second side edge of the base and a rear edge connected to the second side edge of the rear wall. This configuration further comprises a first side wall and a second side wall, wherein the first side wall is connected to the first side edge of the base and is spaced apart from the first rear side wall by a distance substantially equal to the width of the first side wall to form a first side space and is spaced apart from the front edge by a distance substantially equal to the width of the first rear side wall to form a first side front space. Similarly, the second side wall is connected to the second side edge of the base and is spaced apart from the second rear side wall by a distance substantially equal to the width of the second side wall to form a second side space and is spaced apart from the front edge by a distance substantially equal to the width of the second rear side wall to form a second side front space. The front edge has no side wall, thereby forming an open front space. The heights of the rear wall, the first side wall and the second side wall are substantially equal. In this configuration, the stackable storage tray can be inverted and interleaved with a second identical stackable storage tray, such that the rear wall and connected first rear side wall and second rear side wall of the storage tray interleaves with the open front space of the second storage tray and the first and second side front spaces, the first side wall of the storage tray interleaves with the first side space of the second storage tray, and the second side wall of the storage tray interleaves with the second side space of the second storage tray, thereby forming an enclosed box.

In yet another aspect, the present invention provides a stackable storage tray having a sidewall that has a first portion that is higher than a second portion (i.e., one portion is "stepped down" from the other portion), illustrated in FIG. 9. In one embodiment, the first side wall comprises a first portion that is substantially equal in height to the rear wall and a second portion that is lower in height than the rear wall, and the second side wall comprises a first portion that is substantially equal in height to the rear wall and a second portion that is lower in height than the rear wall.

In yet another aspect, the present invention provides a stackable storage tray and box system, comprising a first stackable storage tray, as described herein, and a second stackable storage tray as described herein. The stackable storage tray and box system may comprise a first stackable storage tray and a second stackable storage tray, wherein the first stackable storage tray is stacked or interleaved with the second stackable storage tray.

Particular embodiments of the present invention, as discussed above, are illustrated in the drawings. In reference to the drawings, FIG. 1 generally shows a three-sided tray 1 holding a single organizable, sortable item 2, shown in FIG. 1 as a game box. Tray 1 generally includes a base 3, which constitutes the bottom portion of the tray, a pair of opposing side walls 4 and 5, and a rear wall 6. The side walls 4 and 5 and the rear wall 6 are connected to and extend upwardly from the base wall 3. The height of the side walls 4 and 5, and the rear wall 6 are substantially the same. The length of side walls 4 and 5, represented by measurements 4*a* and 5*a*, respectively, are shown as approximately half the length of their respective sides, leaving open side spaces 7 and 8. It is understood, however, that the length of side walls may vary, depending on the particular design selected, as discussed herein below. The rear wall 6 extends the entire length of its side. The front of the tray includes a lip 9, but contains no walls, leaving it open to receive or dispense organizable, sortable items.

The side walls 4 and 5 and rear wall 6 have a top portion 4*t*, 5*t* and 6*t*, respectively, which contain engagement elements (not shown in FIGS. 1, 2, 3 and 4, but shown in FIGS. 5, 6, 7 and 8). The engagement elements can be any feasible connector known to those skilled in the art, including studs/holes, clasps, straps, etc., that interface with corresponding complementary engagement elements on a second identical stackable tray. For example, complementary elements may be located on the bottom of the base at 4*b* and 5*b* (under side walls 4 and 5) for use in stacking mode, or alternatively may be located on the upper portion of the front lip 9, and side spaces 7 and 8, for use in inverted interleaved mode.

FIG. 2 shows another embodiment of the invention 10, which demonstrates that the side walls can be divided into multiple segments, 14*f* and 14*b*, and 15*f* and 15*b*, with the remaining open spaces divided into front and rear segments 11*f*, 11*b*, and 12*f*, 12*b*. In this case, the organization of side walls and spaces allows for a more open front, making it easier to retrieve tall, wide items from the tray, for example by grasping the items from the side.

Figure 3:
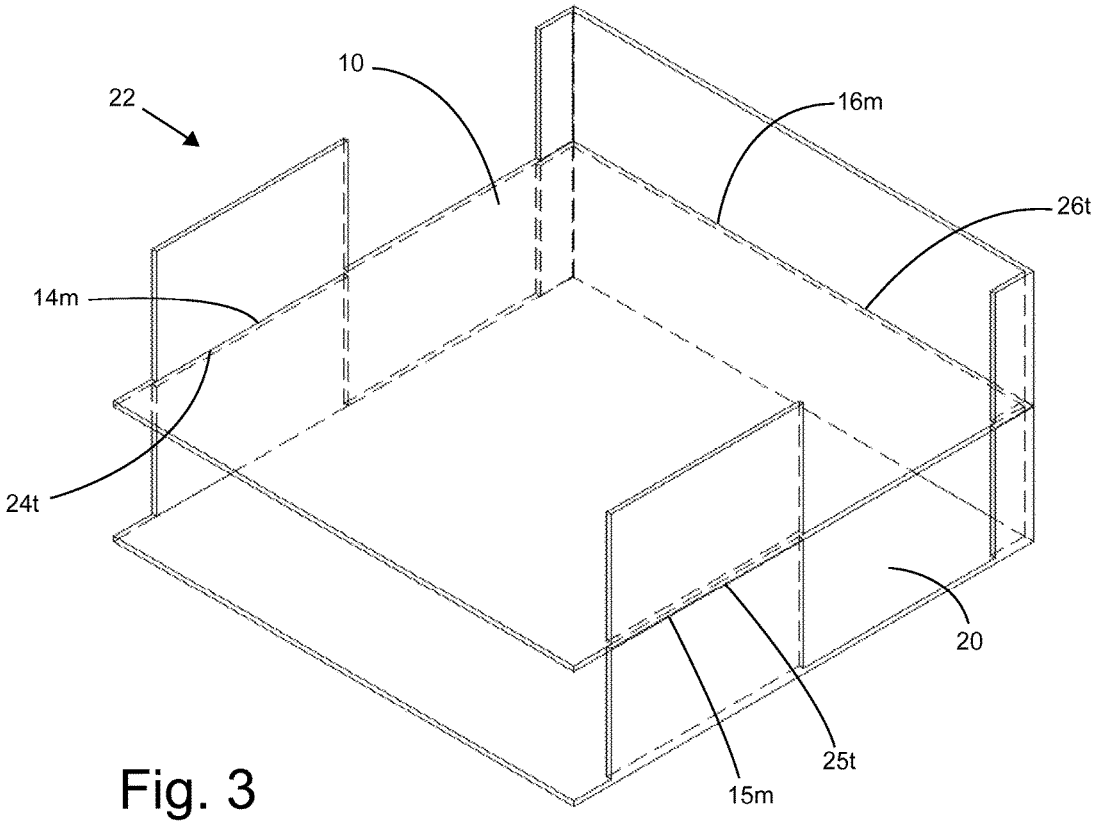
FIG. 3 is a perspective view of two trays of FIG. 2 stacked one on top of the other in a tray stack.

FIG. 3 shows a pair of trays 10 and 20, configured to form a stack of trays, 22. The two trays 10 and 20, are connected via engagement elements (not shown in FIG. 3, but shown in FIGS. 5-8) located on the side wall bottom portions 14*m* and 15*m* and rear wall bottom portion 16*m*, and engagement elements (not shown) located on the side wall top portions 24*t* and 25*t*, and the rear wall top portion 26*t* of tray 20, preventing horizontal and vertical movement.

Figure 4:
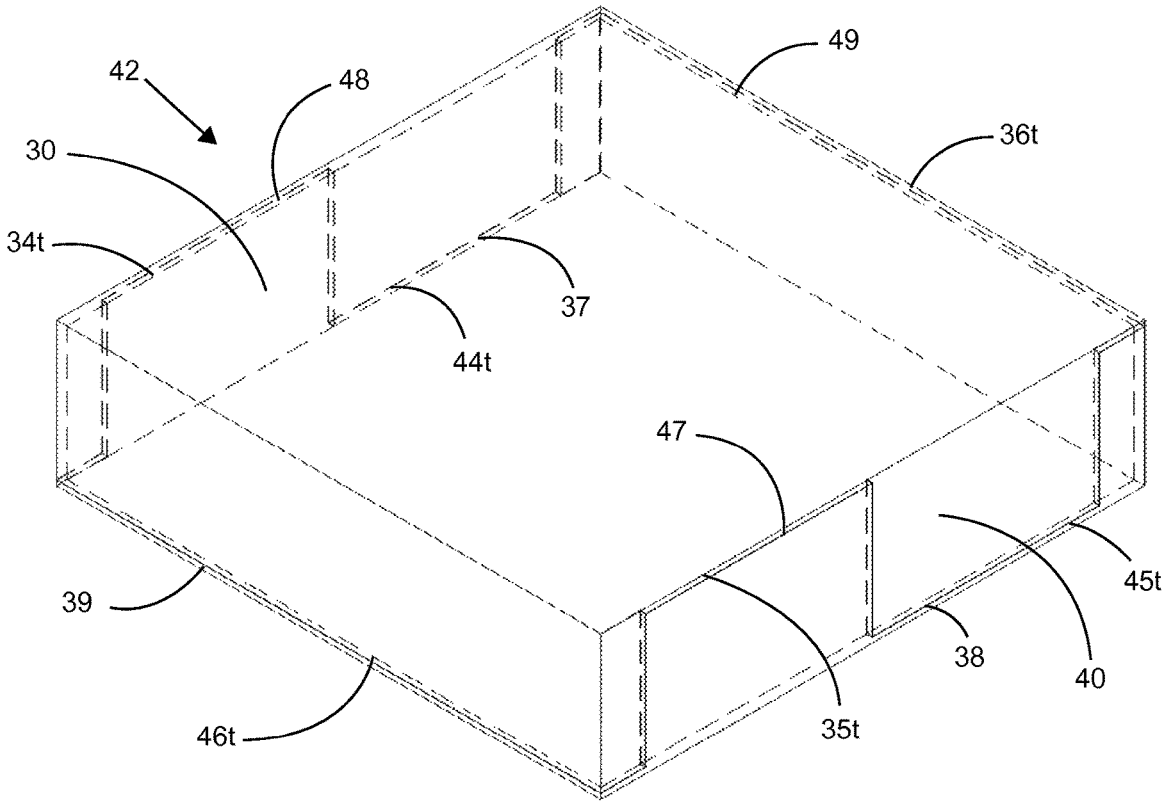
FIG. 4 is a perspective view of two trays of FIG. 2 combined to form a container.

FIG. 4 shows a pair of trays 30 and 40, configured to form a container 42 by inverting one the trays and interleaving the side walls of the upper tray with the spaces of the lower tray. The two trays 30 and 40 are attached via engagement elements (not shown) located on the side wall tops 34*t* and 35*t*, which engage with corresponding complementary engagement elements located on the side spaces 47 and 48, and via engagement elements (not shown) located on the side wall tops 44*t* and 45*t* which engage with corresponding complementary engagement elements located on the side spaces 37 and 38, and finally via engagement elements (not shown) located on the rear wall tops 36*t* and 46*t* which engage with corresponding complementary engagements elements (not shown) located on the front lip 49 and 39, respectively, thereby preventing horizontal and vertical movement.

Figure 6:
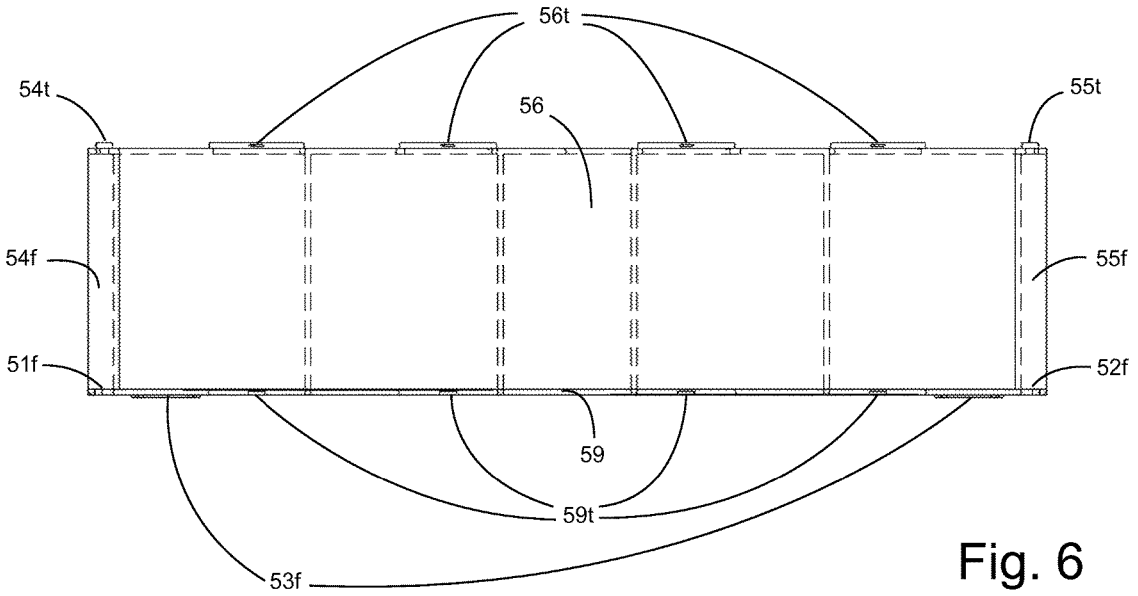
FIG. 6 is a front view of the tray from FIG. 5.
Figure 7:
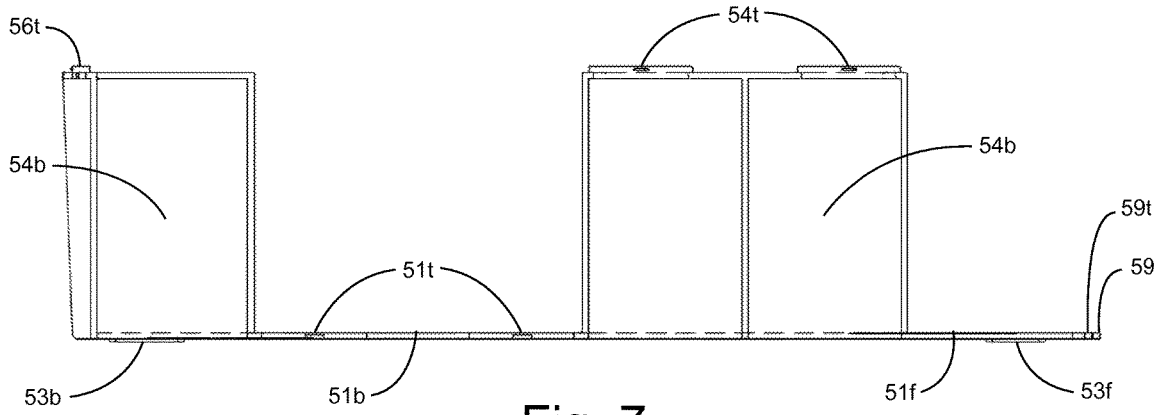
FIG. 7 is a side view of the tray from FIG. 5.
Figure 8:
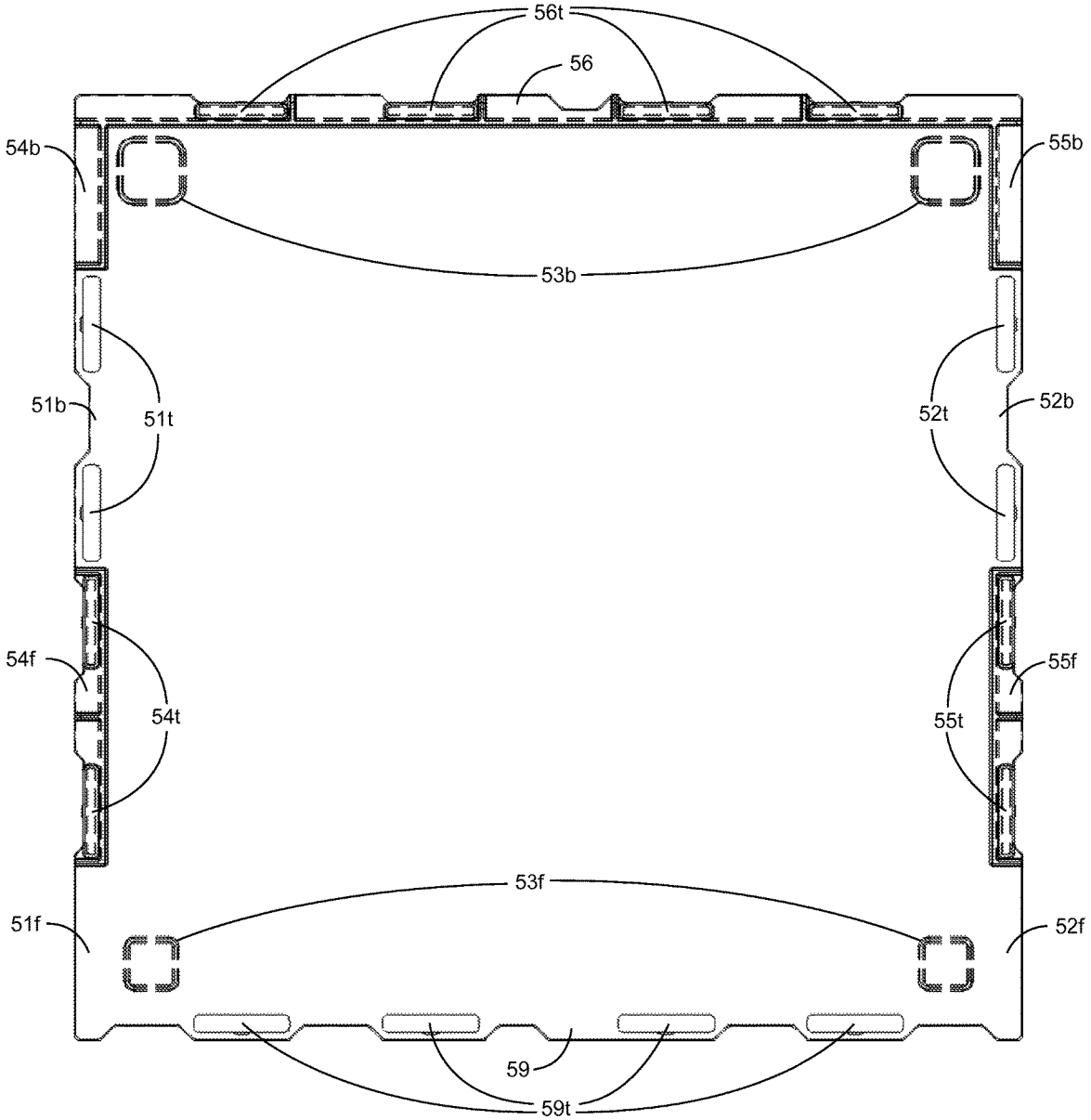
FIG. 8 is a top view of the tray from FIG. 5.

FIG. 5 shows a perspective view of another embodiment of the invention. Stackable tray 50 includes side walls 54*f*, 54*b*, 55*f* and 55*b*, rear wall 56, front lip 59, side spaces 51*f*, 51*b*, 52*f* and 52*b*, side space top engagement elements 54*t* and 55*t*, rear wall engagement element 56*t*, front lip engagement elements 59*t*, and side space engagement elements 51*t* and 52*t*. Tray 50 also includes rear base engagement elements 53*b*, and front base engagement elements 53*f*, which prevent relative fore and aft movement when two containers are stacked one on top of the other. FIG. 6 shows a rear view of the embodiment of FIG. 5. FIG. 7 shows a side view of the embodiment of FIG. 5. FIG. 8 shows a top view of the embodiment of FIG. 5.

FIG. 9 shows another embodiment of the invention. Stackable tray 60 demonstrates that side walls can include multiple segments 64*f*, 64*m*, 64*b*, 65*f*, 65*m* and 65*b*, with multiple wall heights, 64*h*1, 64*h*2, 65*h*1 and 65*h*2, such that each configuration of walls can still form a stackable container by inversion of one tray over another.

Figure 10:
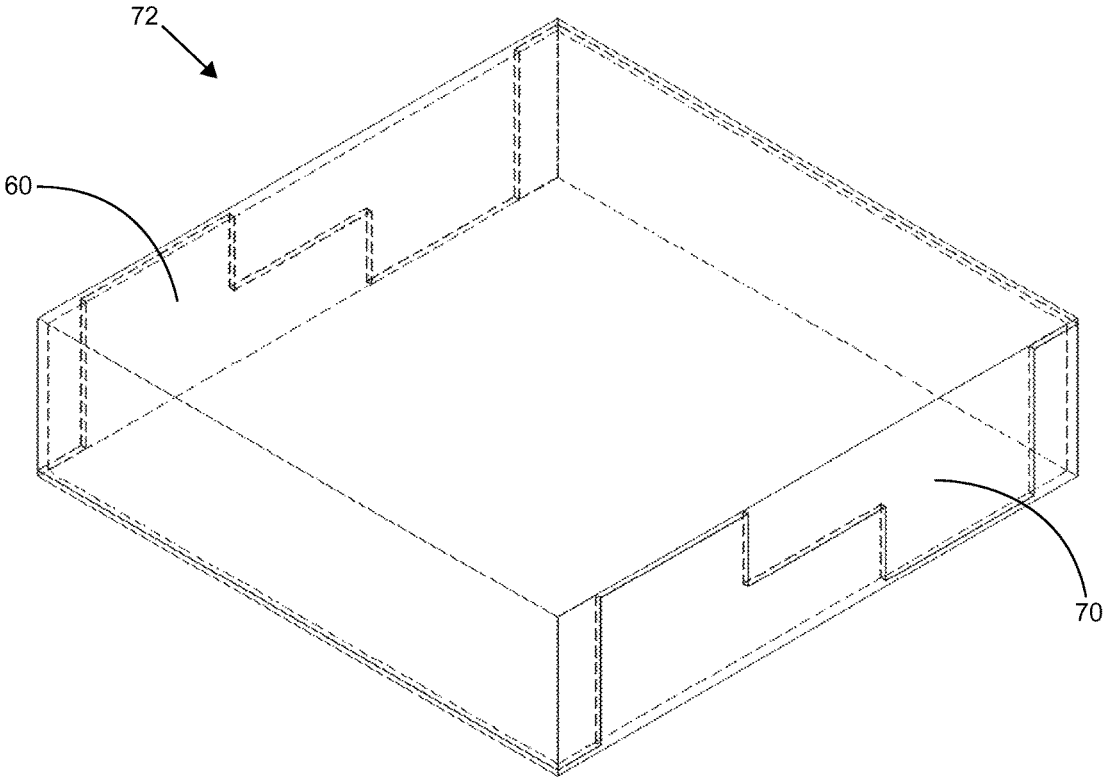
FIG. 10 is a perspective view of two trays of FIG. 9 combined to form a container.
Figure 11:
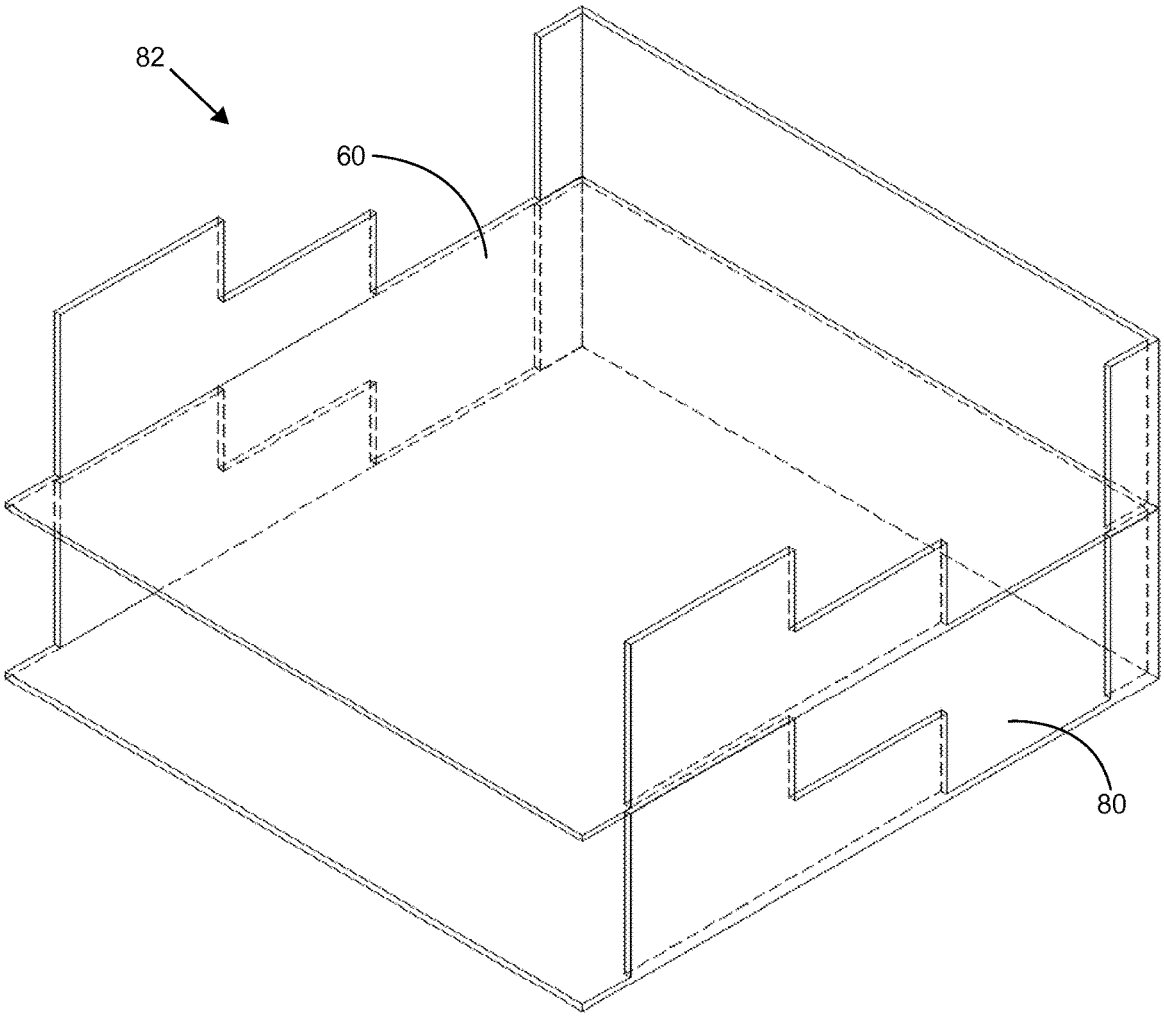
FIG. 11 is a perspective view of two trays of FIG. 9 stacked one on top of the other in a tray stack.

FIG. 10 shows a pair of trays 60 and 70, configured to form a container 72. FIG. 11 shows a pair of trays 60 and 80, configured to form a stacked tray 82.

There is thus disclosed an improved stackable storage tray and storage tray system that is configured to be both stackable and interleavable to form an enclosed container. It will be appreciated that numerous changes may be made to the present invention without departing from the scope of the claims.

What is claimed is:

1. A stackable storage tray, comprising:
   - a base comprising a rear edge, a first side edge, a second side edge and a front edge;
   - a rear wall having a bottom edge connected to the rear edge of the base;
   - a first side wall and a second side wall, wherein the first side wall is connected to the first side edge of the base and is spaced apart from the rear wall by a distance substantially equal to the width of the first side wall to form a first side space, and the second side wall is connected to the second side edge of the base and is spaced apart from the rear wall by a distance substantially equal to the width of the second side wall to form a second side space, and wherein the front edge has no side wall, thereby forming an open front space;
   - wherein the heights of the rear wall, the first side wall and the second side wall are substantially equal;
   - wherein the stackable storage tray is configured to be inverted and interleaved with a second identical stackable storage tray, such that the rear wall of the storage tray interleaves with the open front space of the second storage tray, the first side wall of the storage tray interleaves with the first side space of the second storage tray, and the second side wall of the storage tray interleaves with the second side space of the second storage tray, thereby forming an enclosed box.

2. The stackable storage tray of claim 1, wherein at least two or more of the back side wall, first side wall and second side wall further comprise an engagement element on a top portion, and wherein the stackable storage tray is configured to be stackable on top of the second identical stackable storage tray and the complementary engagement elements engage with corresponding complementary engagement elements on a bottom portion of the base, thereby preventing relative horizontal movement of the first stackable storage tray and second identical stackable storage tray.

3. The stackable storage tray of claim 1, wherein the first side space and second space are substantially equal in width.

4. The stackable storage tray of claim 1, wherein the first side wall comprises a first portion that is substantially equal in height to the rear wall and a second portion that is lower in height than the rear wall, and wherein the second side wall comprises a first portion that is substantially equal in height to the rear wall and a second portion that is lower in height than the rear wall.

5. A stackable storage tray and box system, comprising a first stackable storage tray according to claim 1 and a second stackable storage tray according to claim 1.

6. The stackable storage tray of claim 1, further comprising a third side wall and third space on the first side edge of the base, wherein the third side wall is positioned between the first side wall and the rear wall, and the third side wall has a width that is substantially equal to and is positioned to insert within the third space when the storage tray is inverted and interleaved with a second identical storage tray; and a fourth side wall and fourth space on the second side edge of the base, wherein the fourth side wall is positioned between the second side wall and the rear wall, and the fourth side wall has a width that is substantially equal to and is positioned to insert within the fourth space when the storage tray is inverted and interleaved with a second identical storage tray.

7. The stackable storage tray of claim 6, wherein the height of the third side wall is less than the height of the first side wall and the third space comprises a partial side wall having a height substantially equal to the difference in height between the first side wall and the third side wall, and wherein the height of the fourth side wall is less than the height of the second side wall and the fourth space comprises a partial side wall having a height substantially equal to the difference in height between the second side wall and the fourth side wall.

8. The stackable storage tray of claim 1, further comprising complementary engagement elements on the top of the base in the first side space and second side space that are complementary to the engagement elements on the top of the first side wall and second side wall.

9. The stackable storage tray of claim 8, wherein the engagement elements comprise a curved concave and complementary curved convex shaped surface.

10. The stackable storage tray of claim 8, wherein the engagement elements comprise a plurality of studs and complementary holes.

11. The stackable storage tray of claim 1, further comprising a plurality of first and second side walls spaced apart and configured to interleave with one another.

12. The stackable storage tray of claim 11, wherein the first side space and second side space are substantially equal in width.

13. The stackable storage tray of claim 11, wherein all of the plurality of side walls are substantially equal in height.

14. The stackable storage tray of claim 11, wherein at least two or more of the back side wall, first side wall and second side wall further comprise an engagement element on a top portion, and wherein the stackable storage tray is configured to be stackable on top of the second identical stackable storage tray and the complementary engagement elements engage with corresponding complementary engagement elements on a bottom portion of the base, thereby preventing relative horizontal movement of the first stackable storage tray and second identical stackable storage tray.

15. The stackable storage tray of claim 14, further comprising complementary engagement elements on the top of the base in the first side space and second side space that are complementary to the engagement elements on the top of the first side wall and second side wall.

16. The stackable storage tray of claim 14, wherein the engagement elements comprise a curved concave and complementary curved convex shaped surface.

17. The stackable storage tray of claim 14, wherein the engagement elements comprise a plurality of studs and complementary holes.

18. A stackable storage tray, comprising:

a base comprising a rear edge, a first side edge, a second side edge and a front edge;

a rear wall having a bottom edge connected to the rear edge of the base, a first side edge and a second side edge;

a first rear side wall and second rear side wall, wherein the first rear side wall has a bottom edge connected to the first side edge of the base and a rear edge connected to a first side edge of the rear wall, and the second rear side wall has a bottom edge connected to the second side edge of the base and a rear edge connected to the second side edge of the rear wall;

a first side wall and a second side wall, wherein the first side wall is connected to the first side edge of the base and is spaced apart from the first rear side wall by a distance substantially equal to the width of the first side wall to form a first side space and is spaced apart from the front edge by a distance substantially equal to the width of the first rear side wall to form a first side front space, and the second side wall is connected to the second side edge of the base and is spaced apart from the second rear side wall by a distance substantially equal to the width of the second side wall to form a second side space and is spaced apart from the front edge by a distance substantially equal to the width of the second rear side wall to form a second side front space, and wherein the front edge has no side wall, thereby forming an open front space;

wherein the height of the rear wall, the first side wall and the second side wall is substantially equal;

wherein the stackable storage tray is configured to be inverted and interleaved with a second identical stackable storage tray, such that the rear wall and connected first rear side wall and second rear side wall of the storage tray interleaves with the open front space of the second storage tray and the first and second side front space, the first side wall of the storage tray interleaves with the first side space of the second storage tray, and the second side wall of the storage tray interleaves with the second side space of the second storage tray, thereby forming an enclosed box.

19. The stackable storage tray of claim 18, wherein the first side space and second space are substantially equal in width.

20. A stackable storage tray and box system, comprising a first stackable storage tray according to claim 18 and a second stackable storage tray according to claim 10, wherein the first stackable storage tray is stacked or interleaved with the second stackable storage tray.

21. The stackable storage tray of claim 18, wherein at least two or more of the back side wall, first rear side wall, second rear side wall, first side wall and second side wall further comprise an engagement element on a top portion, and wherein the stackable storage tray is configured to be stackable on top of the second identical stackable storage tray and the complementary engagement elements engage with corresponding complementary engagement elements on a bottom portion of the base, thereby preventing relative horizontal movement of the first stackable storage tray and second identical stackable storage tray.

22. The stackable storage tray of claim 21, further comprising complementary engagement elements on the top of the base in the first side space and second side space that are complementary to the engagement elements on the top of the first side wall and second side wall.

23. The stackable storage tray of claim 21, wherein the engagement elements comprise a curved concave and complementary curved convex shaped surface.

24. The stackable storage tray of claim 21, wherein the engagement elements comprise a plurality of studs and complementary holes.

* * * * *